US009206660B2

(12) United States Patent
Slack et al.

(10) Patent No.: US 9,206,660 B2
(45) Date of Patent: Dec. 8, 2015

(54) CASING FILL-UP FLUID MANAGEMENT TOOL

(75) Inventors: Maurice William Slack, Edmonton (CA); Matthew Allen, Edmonton (CA)

(73) Assignee: NOETIC TECHNOLOGIES INC., Edmonton (CA)

( * ) Notice: Subject to any disclaimer, the term of this patent is extended or adjusted under 35 U.S.C. 154(b) by 452 days.

(21) Appl. No.: 13/634,216

(22) PCT Filed: Mar. 21, 2011

(86) PCT No.: PCT/CA2011/000299

§ 371 (c)(1), (2), (4) Date: Sep. 11, 2012

(87) PCT Pub. No.: WO2011/113155

PCT Pub. Date: Sep. 22, 2011

(65) Prior Publication Data

US 2013/0000917 A1 Jan. 3, 2013

Related U.S. Application Data

(60) Provisional application No. 61/315,588, filed on Mar. 19, 2010.

(51) Int. Cl.

| | |
|---|---|
| ***E21B 21/10*** | (2006.01) |
| *E21B 33/16* | (2006.01) |
| *E21B 33/12* | (2006.01) |
| *E21B 34/06* | (2006.01) |

(52) U.S. Cl.

CPC ..... *E21B 21/10* (2013.01); *E21B 21/103* (2013.01); *E21B 33/12* (2013.01); *E21B 33/16* (2013.01); *E21B 34/06* (2013.01)

(58) Field of Classification Search

CPC ..... E21B 21/10; E21B 34/06; E21B 33/12; E21B 33/14; E21B 33/16; E21B 21/103

See application file for complete search history.

(56) References Cited

U.S. PATENT DOCUMENTS

| | | | | |
|---|---|---|---|---|
| 2,061,480 | A | 11/1936 | Pigott | |
| 2,231,861 | A | 2/1941 | Adams | |
| 3,543,849 | A * | 12/1970 | Kilgore | 166/128 |

(Continued)

OTHER PUBLICATIONS

International Preliminary Report on Patentability (IPRP-I) issued Sep. 25, 2012 by the International Bureau of WIPO, and incorporating Written Opinion of the International Searching Authority (CIPO) dated May 26, 2011 re PCT/CA2011/000299.

*Primary Examiner* — Nicole Coy

(74) *Attorney, Agent, or Firm* — Donald V. Tomkins

(57) ABSTRACT

A fluid management tool for introducing fluids into a casing string incorporates a mud saver valve configured to open and allow fluid flow in response to fluid flow pressure reaching a predetermined opening pressure, and will automatically close when fluid flow pressure is reduced to or below a predetermined closure pressure, thereby preventing fluid spillage when the tool is withdrawn from the casing. The mud saver valve includes a mud saver spool having a slotted spool cage and being axially movable within a longitudinal bore in the main body of the tool, between an upper or open position in which fluid can flow out of the spool cage and into a discharge bore at the lower end of the main body, and a lower or closed position in which the lower end is seated against the exit bore to prevent flow therethrough. A check valve may be incorporated into the lower end of the mud saver spool. The fluid management tool also may incorporate a main seal and air bleed valve subassembly and a secondary suction seal and check valve subassembly.

40 Claims, 9 Drawing Sheets

(56) References Cited

U.S. PATENT DOCUMENTS

| | | | | |
|---|---|---|---|---|
| 4,254,836 | A | 3/1981 | Russell | |
| 7,604,063 | B2 | 10/2009 | Mashburn | |
| 2010/0314838 | A1* | 12/2010 | Slack | 277/520 |
| 2012/0080854 | A1 | 4/2012 | Slack et al. | |

* cited by examiner

CASING FILL-UP FLUID MANAGEMENT TOOL

FIELD

The present disclosure relates in general to apparatus and methods for introducing fluids into a casing string or other tubular element during well construction operations, and for removing fluids from the casing string. In particular, the disclosure relates to apparatus and methods for introducing a fluid such as drilling mud or cement slurry into a casing string where the introduced fluid displaces air that must be vented from the casing.

BACKGROUND

Typical construction of an oil or gas well includes the operations of assembling a casing string, inserting the casing string into a wellbore, and cementing the casing in place in the wellbore. Casing assembly involves connecting multiple individual lengths of pipe (or "joints") to form an elongate casing string. Threaded connections are usually used to join the individual lengths of pipe, requiring the application of torque to "make up" the connections, or to "break out" the connections should the string need to be disassembled.

After a wellbore has been drilled to a desired depth into a subsurface formation, by means of a rotating drill bit mounted to the end of a drill string, the drill string is withdrawn and the casing string is then inserted essentially coaxially within the wellbore. In the alternative method known as casing drilling (or "drilling with casing"), the wellbore is drilled with a drill bit mounted to the bottom of the casing string, eliminating the need for a separate drill string. After the well is drilled, the casing remains in the wellbore. As used in this patent document, the term "drill string" is to be understood, in the context of the drilling phase, as referring to the casing string for purposes of well construction operations using casing drilling methods.

During the drilling phase of well construction, a selected drilling fluid (commonly called "drilling mud") is pumped under pressure downward from the surface through the drill string, out through ports in the drill bit into the wellbore, and then upward back to the surface through the annular space that forms between the drill string and the wellbore (due to the fact that the drill bit diameter is larger than the drill string diameter). The drilling fluid, which may be water-based or oil-based, carries wellbore cuttings to the surface, and can serve other beneficial functions including drill bit cooling, and formation of a protective cake to stabilize and seal the wellbore wall.

Once the well has been drilled to a desired depth and the casing is in place within the wellbore, the casing is cemented into place by introducing a cement slurry (commonly referred to simply as "cement") into the wellbore annulus. This is typically done by introducing an appropriate volume of cement into the casing string (i.e., a volume corresponding to the volume of the wellbore annulus), and then introducing a second and lighter fluid (such as drilling mud or water) into the casing under pressure, such that the second fluid will displace the cement downward and force it out and around the bottom of the casing, and up into the wellbore annulus. In the typical case, this operation is continued until the cement has risen within the wellbore annulus up to the top of the casing. Once thus cemented, the casing acts to structurally line the wellbore and provide hydraulic isolation of formation fluids from each other and from wellbore fluids.

It is increasingly common in the drilling industry to use top-drive-equipped drilling rigs instead of traditional rotary table rigs, and to install casing (an operation commonly referred to as "casing running") and/or to drill with casing directly using the top drive. Casing running tools, such as the "Gripping Tool" described in U.S. patent application Ser. No. 11/912,665 (Publication No. US 2008/0210063), connect to the top drive quill and support these well construction operations by engaging the upper end of the tubular string (i.e., drill string or casing string, as the case may be) so as to allow transfer of axial and torsional loads between the tubular string and the top drive, and to allow the flow of fluids (such as drilling mud and cement) into or out of the casing string through a central passage or bore in the tool. Such tools thus enable the top drive to be used for make-up and break-out of connections between joints of pipe, hoisting and rotation of tubular strings, casing fill-up, circulation of drilling mud, and cementing of casing.

Whenever a casing running tool (or "CRT") is disengaged and removed from the casing after flowing liquids into a drill string or casing string, liquids such as drilling mud tend to drain from the tool bore, resulting in undesirable spillage onto the drill floor of the drilling rig and/or elsewhere.

Additionally, when a CRT is used to add liquids such as drilling mud or cement to a partially-filled casing string (i.e., casing fill-up and cementing operations, respectively), the liquid displaces air which through gravity separation tends to accumulate or become trapped at the upper end of the casing string below the CRT. In situations where the CRT is in sealing engagement with the casing, this results in an increase of air pressure within the casing. When the CRT is then removed from the upper end of the casing string, the pressurized air abruptly vents to atmosphere, which is typically undesirable even for relatively low levels of trapped pressure.

During cementing operations, the cement is frequently denser than the liquids being displaced, leading to conditions where the cement continues to fall within the wellbore after pumping is stopped, tending to induce suction pressure in the casing and hence to draw air into the casing, which may then interfere with subsequent fluid displacement operations.

For the foregoing reasons, there is a need for apparatus and methods for improving the management of fluids in conjunction with the use of casing running tools, to prevent or minimize spillage of drilling mud or cement, to mitigate the effects of trapped air during casing fill-up, and to prevent air entry into the casing due to suction.

BRIEF SUMMARY

The present disclosure addresses the foregoing needs by providing a fluid management tool (or "FMT") configured for insertion into the upper end of a tubular article or tubular assembly such as but not limited to a casing string. As used in this patent document, the terms "casing" and "casing string" are to be understood in context as covering tubular articles and tubular assemblies of any type, and not limited to tubular assemblies used specifically for well-casing purposes. The FMT includes a main body having an exterior surface and defining a main body flow path extending between the FMT's upper and lower ends. The main body is sealingly connectable to an upstream flow line to facilitate fluid flow from the flow line into and through the main body via the main body flow path. When the FMT is inserted into a casing string, an annulus is formed between the exterior surface of the FMT and the interior surface of the casing; this annulus will be referred to herein as the "casing annulus", to distinguish it from the previously-mentioned "wellbore annulus" formed between the casing and the wellbore.

In accordance with one embodiment, the FMT incorporates a mud saver valve defining a mud saver flow path coincident with a medial region of the main body flow path. The mud saver valve is configured to prevent significant leakage flow from the flow line through the main body flow path, below a selected differential pressure in the downstream direction, while also allowing backflow into the upstream flow line at negligible cracking pressure (i.e., mud saver reopening pressure) in the upstream direction.

In one aspect, therefore, the present disclosure teaches a fluid management tool comprising:

(a) an elongate main body having an upper end, a lower end, and a main body bore extending between said upper and lower ends, with the main body bore including: an upper interval; a middle interval defining a middle main bore surface (alternatively referred to as an upper mud saver seal surface) having a cross-sectional area $A_1$; and a lower interval defining a lower main bore surface (alternatively referred to as a lower mud saver seal surface) having a cross-sectional area $A_2$;

(b) an end cap mounted to the lower end of the main body, with the end cap having an upper end defining an end cap seal surface, and an end cap discharge bore in fluid communication with the main body bore;

(c) a spool (alternatively referred to as a mud saver spool) having an upper end, a lower end, and a spool bore extending between the spool's upper and lower ends, with the spool comprising:

c.1 an upper spool section having a peripheral surface;

c.2 a middle spool section having a peripheral surface;

c.3 a spool cage (alternatively referred to as a mud saver spool cage) having at least one slot; and c.4 a nose cone at the lower end of the spool, with the nose cone defining a nose cone seal surface; with the spool being disposed and axially movable within the main body bore, with the upper spool section disposed within the middle interval of the main body bore, and with the middle spool section and the spool cage disposed within the lower interval of the main body bore;

(d) upper seal means, for sealing between the peripheral surface of the upper spool section and the middle main bore surface;

(e) lower seal means, for sealing between the peripheral surface of the middle spool section and the lower main bore surface; and (f) mud saver spool biasing means biasing the mud saver spool toward a closed position in which the nose cone seal surface is in sealing engagement with the end cap seal surface over a contact seal region enclosing an area $A_3$;

wherein area $A_3$ is less than area $A_2$, and $A_1$ is less than the difference between area $A_2$ and area $A_3$. Preferably (but not necessarily), the middle main bore surface, the lower main bore surface, the peripheral surface of the upper spool section, and the peripheral surface of the middle spool section will be axi-symmetric.

In one alternative embodiment, the upper spool section is configured such that an annular chamber is formed between the upper spool section and the middle main bore surface, to facilitate venting of the region between the upper and lower seal means. This may be accomplished by, for instance, forming the upper spool section to define a radially-extending flange comprising the peripheral surface of the upper spool section. However, the upper spool section is not limited to this or any other particular configuration, whether forming an annular chamber as described above, or otherwise.

In another alternative embodiment, the main body comprises an upper section and a coaxial lower section, with the upper section being typically (but not necessarily) cylindrical, with the outer diameter of the upper section being less than the diameter of the lower section such that an upwardly-oriented annular exterior shoulder is formed at the juncture of the upper and lower sections. In this embodiment, an annular main seal and air bleed valve subassembly are disposed around the upper section of the main body of the FMT. The main seal is configured for peripheral sealing engagement with the inside surface of a casing string into which the FMT has been inserted. The air bleed valve is configured as a flow control valve, to allow fluids (gaseous or liquid) to bypass the main seal and escape from the interior of the casing up to a selected differential closure pressure across the main seal. The air bleed valve is adapted to close and to remain closed at pressures at or above the selected differential closure pressure, thereby preventing further fluid bypass, while also being configured to reopen when at a selected reopening pressure less than the selected closure pressure.

Optionally, the main body may also carry a secondary suction seal and, optionally, a check valve above the main seal, to provide sealing against fluids such as air tending to enter the casing through the casing annulus, with the check valve being arranged to allow fluids escaping through the air bleed valve to bypass the secondary suction seal. This check valve functionality may be provided integrally with the suction seal in the manner of a unidirectional seal. The check valve may have a finite, non-zero opening pressure. Notwithstanding the provision of the check valve, however, fluid escape from the annulus during typical operating conditions would result from the suction seal being selectively placed in an open position, rather than being via the air bleed valve.

Another alternative embodiment of a fluid management tool in accordance with the present disclosure comprises a main body having upper and lower sections as described above, as well as a longitudinal bore, with a main seal and air bleed valve subassembly mounted around the upper section of the main body as described above, but does not include a mud saver valve. In a first variant of this alternative embodiment, a secondary suction seal and, optionally, a check valve are disposed around the upper section of the main body, above the main seal and air bleed valve subassembly, also as described above. In a second variant of this alternative embodiment, the upper section of the main body may carry a secondary suction seal and, optionally, a check valve without a main seal and air bleed valve subassembly.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Figure 1:
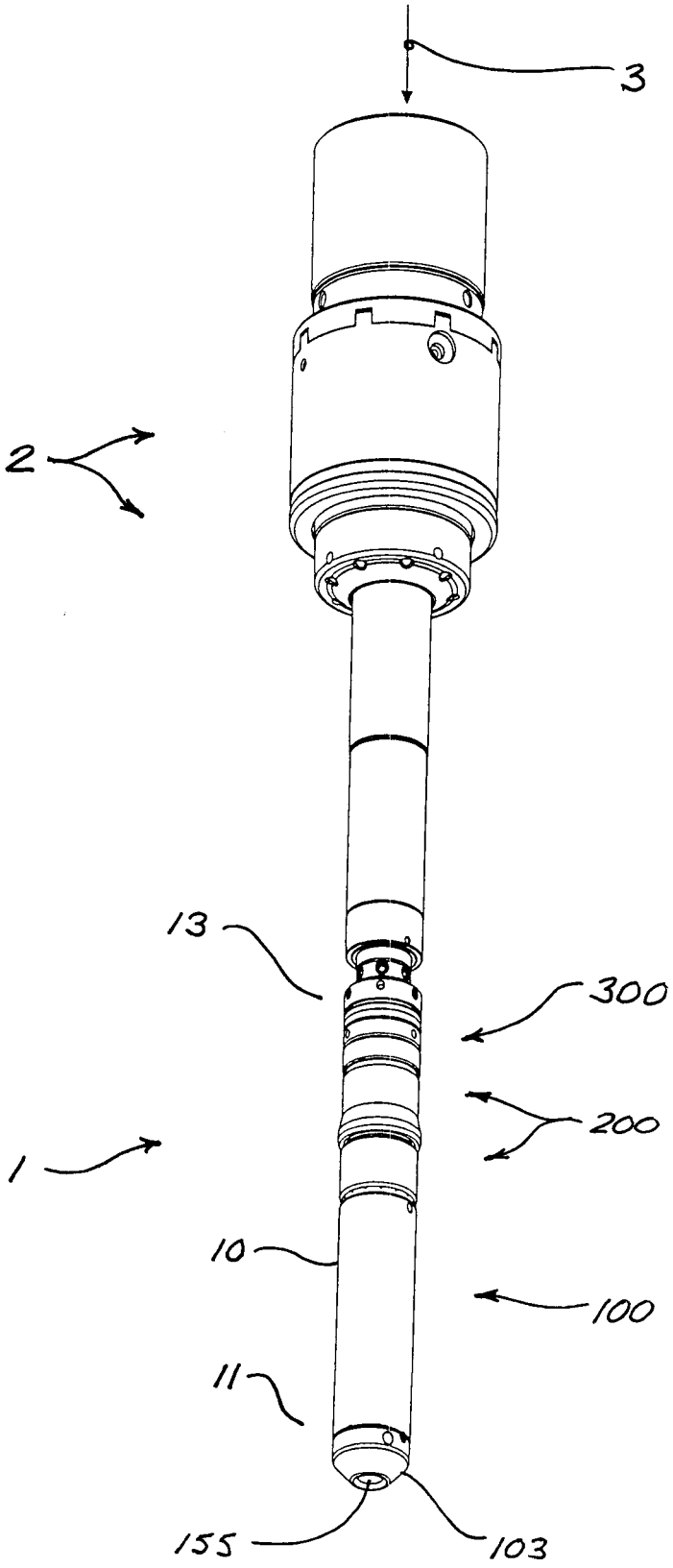
FIG. 1 is an isometric view of one embodiment of a fluid management tool ("FMT") in accordance with the present disclosure, shown connected to the lower end of a casing running tool ("CRT").
Figure 2:
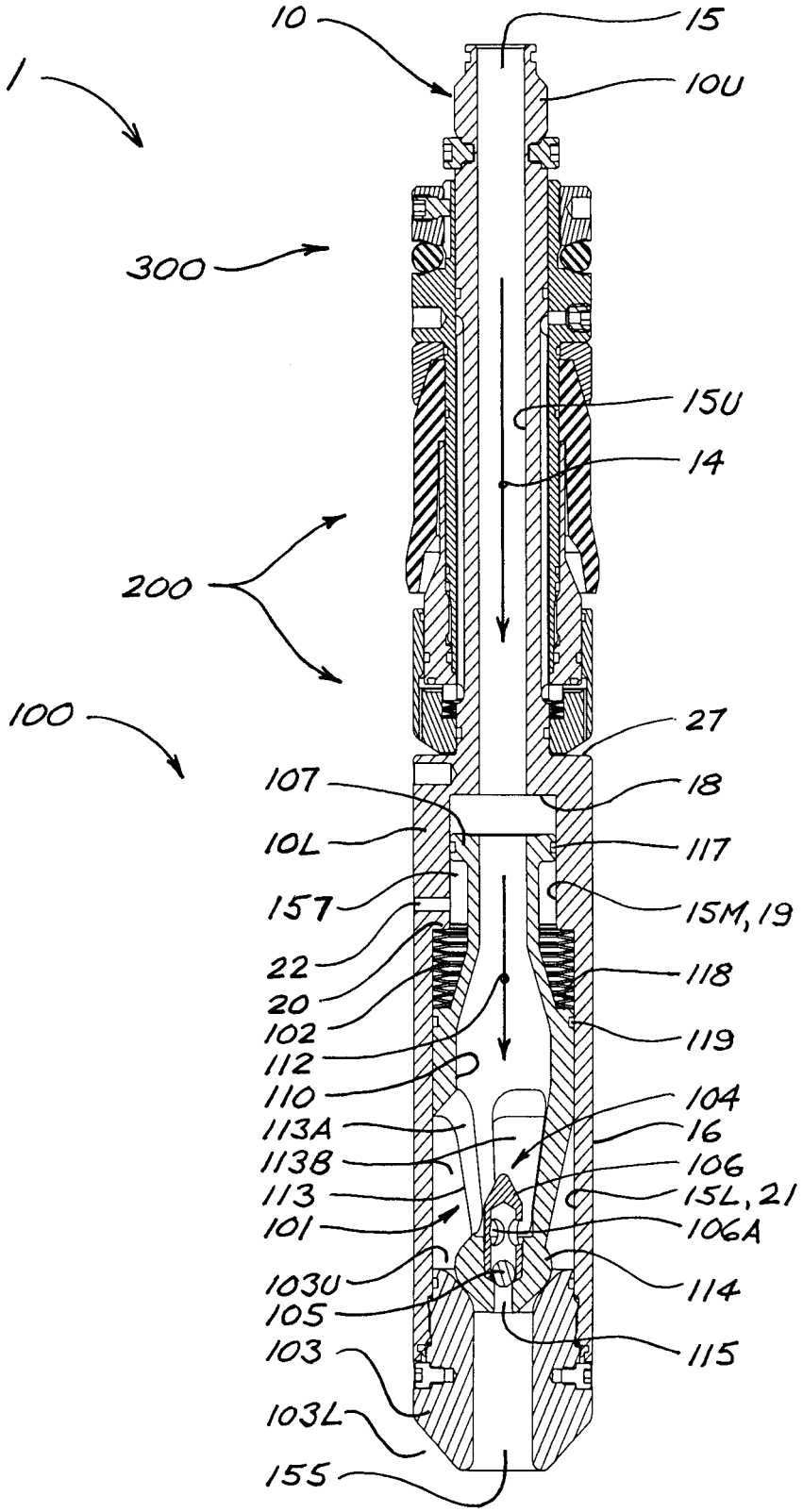
FIG. 2 is a section through the FMT shown in FIG. 1.

FIGS. 1 and 2 illustrate an embodiment of a fluid management tool ("FMT") 1 in accordance with the present disclosure. FMT 1 has an upper end 13 and a lower end 11, and is shown in FIG. 1 with upper end 13 connected to the lower end of a casing running tool 2, and with an upstream flow line (represented by reference number 3) connected to casing running tool 2. As shown in cross-section in FIGS. 2 and 4 (and other Figures), FMT 1 comprises an elongate main body 10 having an upper section 10U and a lower section 10L. Main body 10 is of generally axi-symmetric configuration; i.e., symmetrical about a longitudinal axis. Lower section 10L of main body 10 has a wall 16 with an outer diameter greater than the outer diameter of upper section 10U. Although upper and lower sections 10U and 10L will preferably and most conveniently be of generally cylindrical configuration, upper and lower sections 10U and 10L or portions thereof could be of other configurations in alternative embodiments within the scope of the present disclosure.

Lower section 10L of main body 10 terminates in an end cap 103 which has an upper end 103U defining an end cap seal surface 156; a lower end 103L; and an end cap discharge bore 155. End cap 103 is sealingly mounted to the lower end of lower section 10L of main body 10, typically by means of a threaded connection 150. The exterior profile of the lower end 103L of end cap 103 is preferably tapered to facilitate insertion of FMT 1 into a casing string.

Main body 10 is illustrated in the Figures as being of unitary construction, but this is by way of example only and not in any way essential. Persons skilled in the art will appreciate that main body 10 (and other illustrated components) alternatively could be fabricated and assembled from multiple subcomponents. Similarly, persons skilled in the art will appreciate that components illustrated as being assembled from multiple subcomponents alternatively could be of unitary construction.

Main body 10 has a longitudinal bore 15 defining a main body flow path 14, and configured to define three stepped intervals of increasing cross-sectional dimensions from upper end 13 toward lower end 11, as follows:

- an upper interval 15U (typically but not necessarily cylindrical);
- a middle interval 15M having an inner cylindrical surface 19 (also referred to as the upper mud saver seal surface 19); and
- a lower interval 15L having an inner cylindrical surface 21 (also referred to as the lower mud saver seal surface 21).

A downwardly-oriented upper mud saver shoulder 18 is provided at the juncture of upper interval 15U and middle interval 15M of bore 15; and a downwardly-oriented upper spring shoulder 20 is provided at the juncture of middle interval 15M and lower interval 15L.

In the illustrated embodiment, main body 10 carries three subassemblies: a mud saver valve 100 within lower interval 15L of bore 15; a main seal and air bleed valve subassembly 200 disposed around upper section 10U of main body 10; and a suction seal subassembly 300 disposed around upper section 10U of main body 10 above main seal and air bleed valve subassembly 200.

Figure 3:
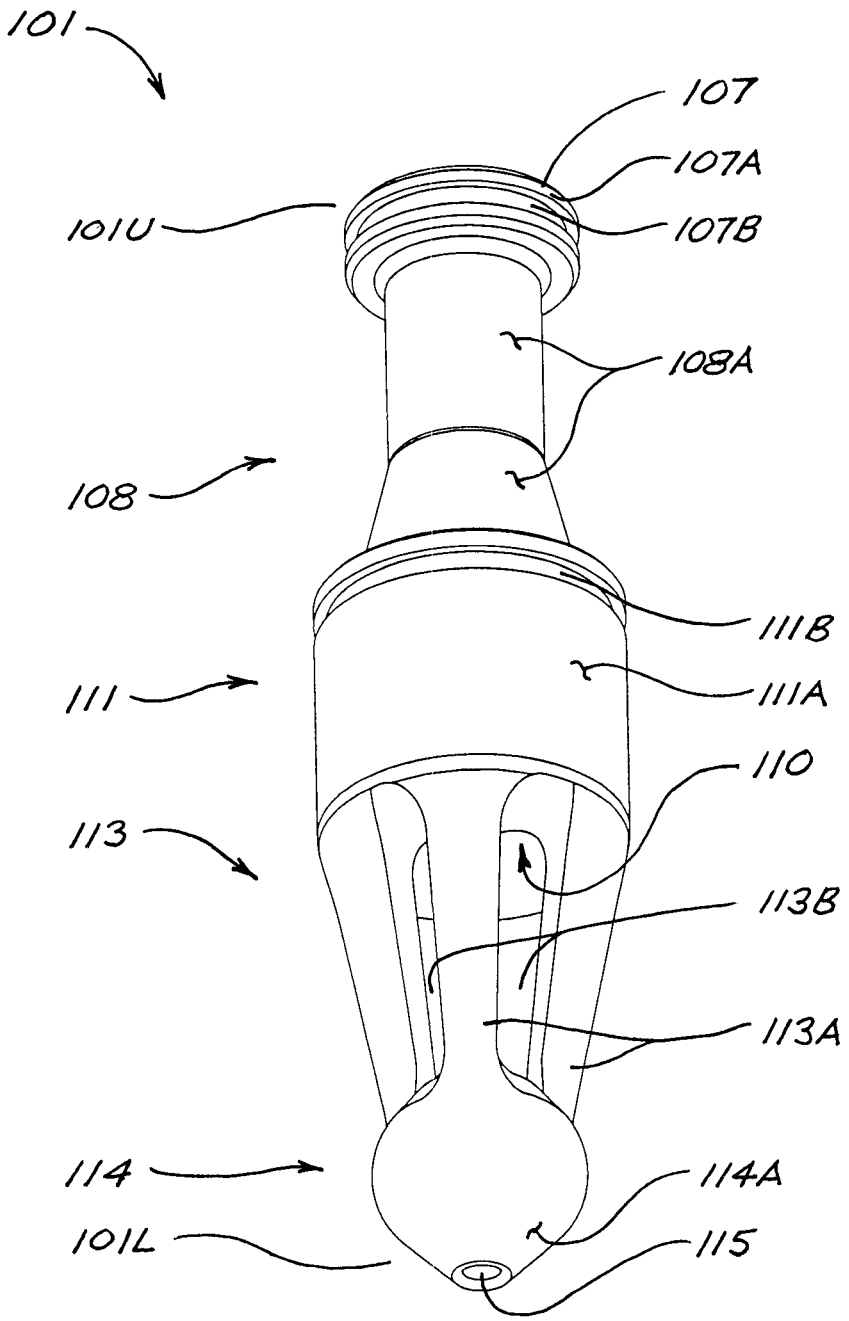
FIG. 3 is an isometric view of the mud saver valve spool of the FMT in FIG. 1.
Figure 4:
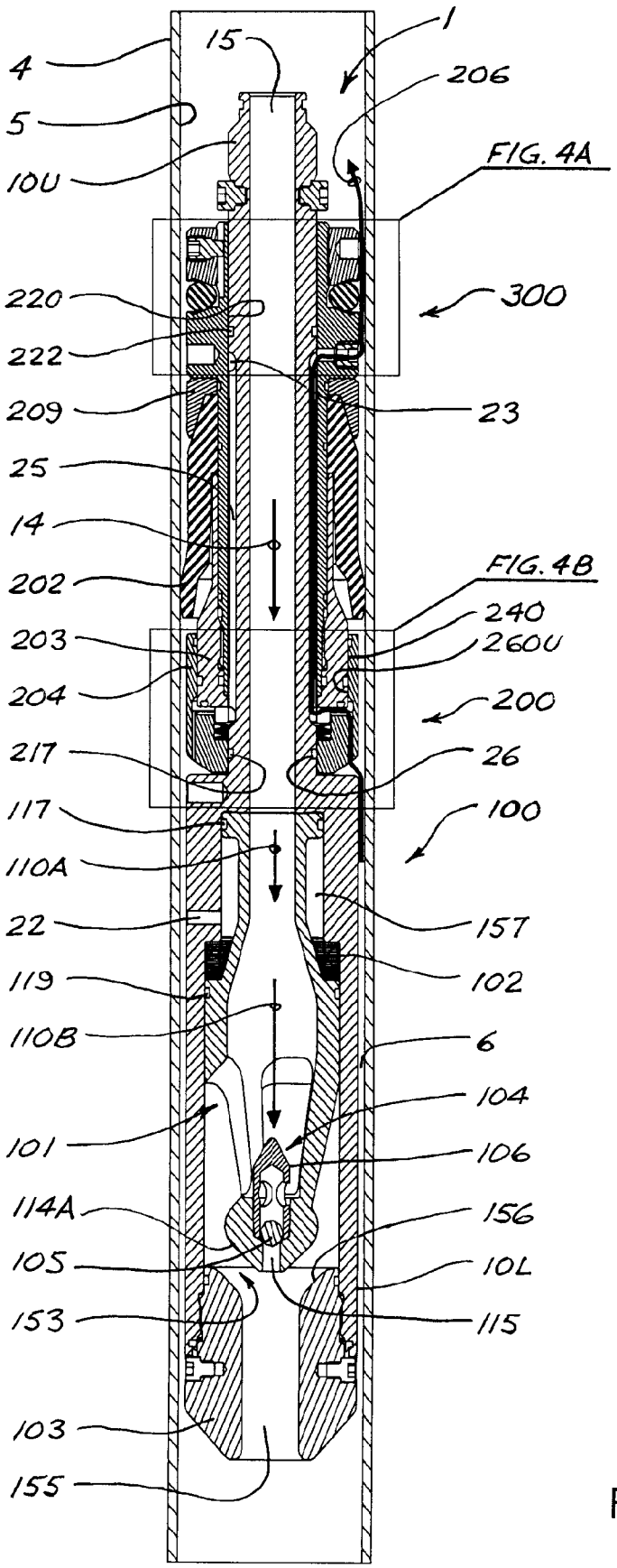
FIG. 4 is a section through the FMT in FIG. 2, shown inserted into the upper end of a casing string and as it would appear during casing fill-up; i.e., with mud saver valve open, air bleed valve open, and secondary suction seal disengaged from the casing.

As shown in FIGS. 2-4 in particular, mud saver valve 100 in accordance with the illustrated embodiment comprises a mud saver spool 101 having an upper end 101U and a lower end 101L, and incorporates the following an upper section 108 having an outer surface 108A and a flange 107 projecting radially outward from an upper region of upper section 108 and having a peripheral surface 107A;

- a middle section 111 at least a portion of which includes a cylindrical peripheral surface 111A having an annular groove 111B for receiving a lower spool seal 119 configured for sealing contact with lower mud saver seal surface 21;
- a spool cage 113 comprising a plurality of spool cage ribs 113A with one or more intervening spool cage slots 113B, with the lower end of spool cage 113 terminating in a nose cone 114, with nose cone 114 defining a nose cone bore 115 and a nose cone seal surface 114A configured for sealing engagement with end cap seal surface 156; and
- a backflow valve 104 associated with nose cone 114 and nose cone bore 115.

Peripheral surface 107A of flange 107 has an annular groove 107B for receiving an upper spool seal 117 configured for sealing contact with upper mud saver seal surface 19. Outer surface 108A of upper section 108 may be (but need not necessarily be) cylindrical, but in any event will have no outer cross-sectional dimension equal to or greater than the diameter of middle interval 15M of bore 15. Upper section 108 and outer surface 108A may comprise a tapered transition section as seen in FIG. 3, but this is not an essential requirement.

It is to be understood that while it is preferable for FMT 1 to incorporate backflow valve 104, it is not essential to all embodiments within the scope of the present disclosure. In alternative embodiments not including a backflow valve, nose cone 114 will not require a nose cone bore.

An upwardly-oriented lower spring shoulder 118 is provided at the juncture of upper and lower sections 108 and 111 of mud saver spool 101. A mud saver spool bore 110 defining a mud saver flow path 112 extends from upper end 101U of mud saver spool 101 through flange 107, upper section 108, middle section 111, and into spool cage 113, thus enabling fluid flow downward through mud saver spool bore 110 and out through spool cage slots 113B. The portion of mud saver spool bore 110 associated with upper and lower sections 108 and 111 of mud saver spool 101 may be referred to as the mud saver entry bore 110A, and the portion of mud saver spool bore 110 associated with spool cage 113 may be referred to as the mud saver cage bore 110B (with mud saver entry bore 110A and mud saver cage bore 110B of course being coincident with mud saver flow path 112).

In the illustrated embodiment, backflow valve 104 is provided in the form of a check valve, and more specifically as a ball check valve comprising a check valve cage 106 which retains a check ball 105 preventing fluid outflow downward through nose cone bore 115 when check ball 105 is seated in a valve seat 106B in a lower region of check valve cage 106 (best seen in FIG. 5), while allowing backflow upward through nose cone bore 115 into spool bore 110 via fluid openings 106A in check valve cage 106.

In alternative embodiments, check valve 104 may include a check ball biasing spring 105A (shown in FIG. 6) of any suitable type to bias check ball 105 toward the lower end of check valve cage 106 so as to close off flow through nose cone bore 115. One benefit of such a check ball bias spring would to prevent movement of check ball 105 during shipment or transit of FMT 1, and for that purpose the check ball bias spring would not need to be particularly stiff (but should be relatively less stiff than mud saver bias spring 102). Incorporation of a check ball bias spring in check valve 104 may also the benefit of allowing check valve 104 to serve as a pressure relief valve (PRV) to relieve casing pressure above a PRV opening pressure correlated to the selected stiffness (i.e., spring constant) of the check ball bias spring.

Optionally, the material compliance of check ball 105, in combination with the geometry of valve seat 106B and the diameter of nose cone bore 115, may be selected to provide a pressure relief function similar to a "rupture disc" (a term that will be understood by persons skilled in the art), such that if the function of mud saver valve 100 is impaired to such a degree that it fails to open under applied pressure load, check ball 105 will be extruded downward through nose cone bore 115 at a pressure lower than a pressure that exceeds the containment capacity of the main body 10 and end cap 103. After such an occurrence, the lack of pressure containment will serve as an indicator of valve failure.

For general reference purposes, mud saver valve 100 may be considered as the subassembly comprising lower section 10L of main body 10, mud saver spool 101, check valve 104, and end cap 103.

In the assembled FMT 1 as shown in FIG. 2, mud saver spool 101 is disposed within bore 15 of main body 10 such that mud saver flow path 112 is coincident with main body flow path 14 in a region corresponding to middle interval 15M and lower interval 15L of bore 15. Flange 107 at upper end 101U of mud saver spool 101 is longitudinally movable within middle interval 15M of lower interval 15L of bore 15, with lower section 111 and spool cage 113 being correspondingly movable within lower interval 15L of bore 15. Upper spool seal 117 is slidable in sealing engagement with upper mud saver seal surface 19, and lower spool seal 119 is slidable in sealing engagement with lower mud saver seal surface 21, such that an annular chamber 157 is formed between upper spool seal 117 and lower spool seal 119.

Figure 5:
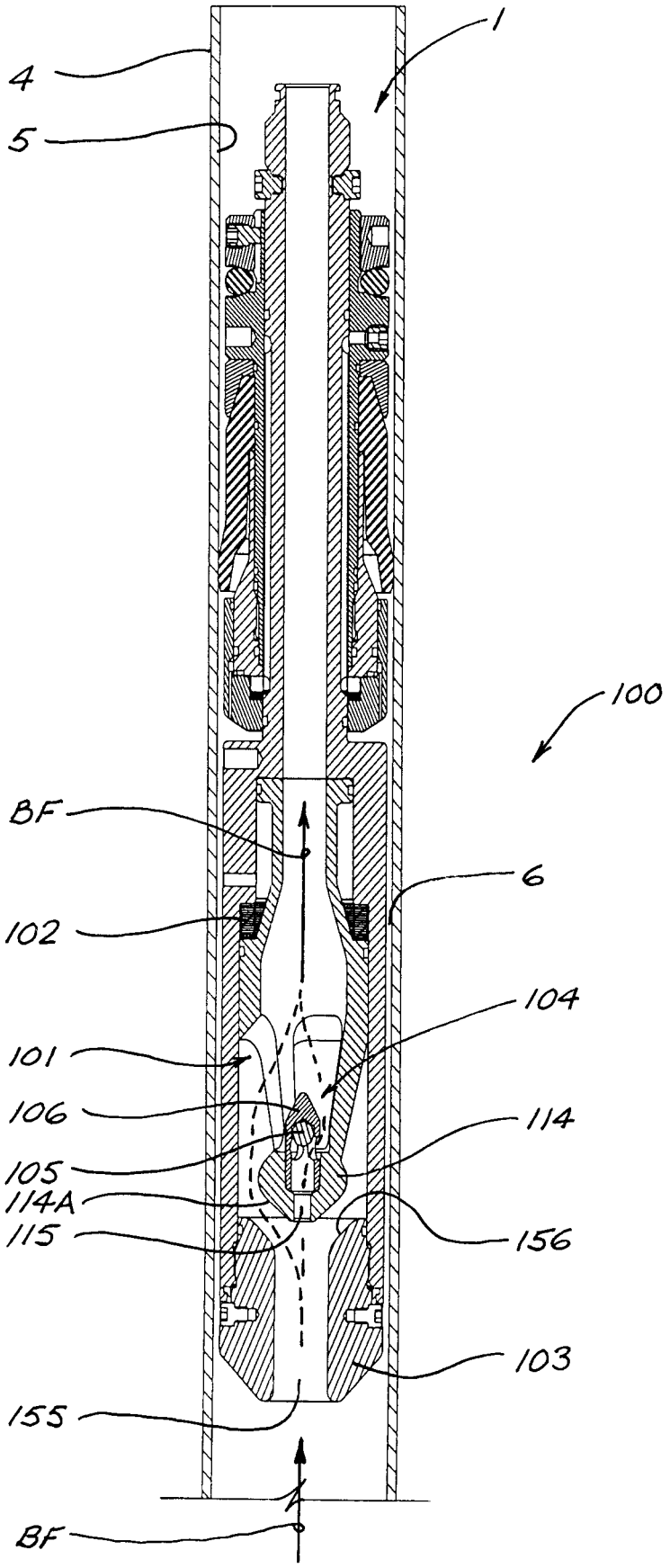
FIG. 5 is a section similar to FIG. 4 but showing the FMT as it would appear during backflow with sufficient casing pressure to close the air bleed valve; i.e., with check valve open, mud saver valve open, and air bleed valve closed.
Figure 6:
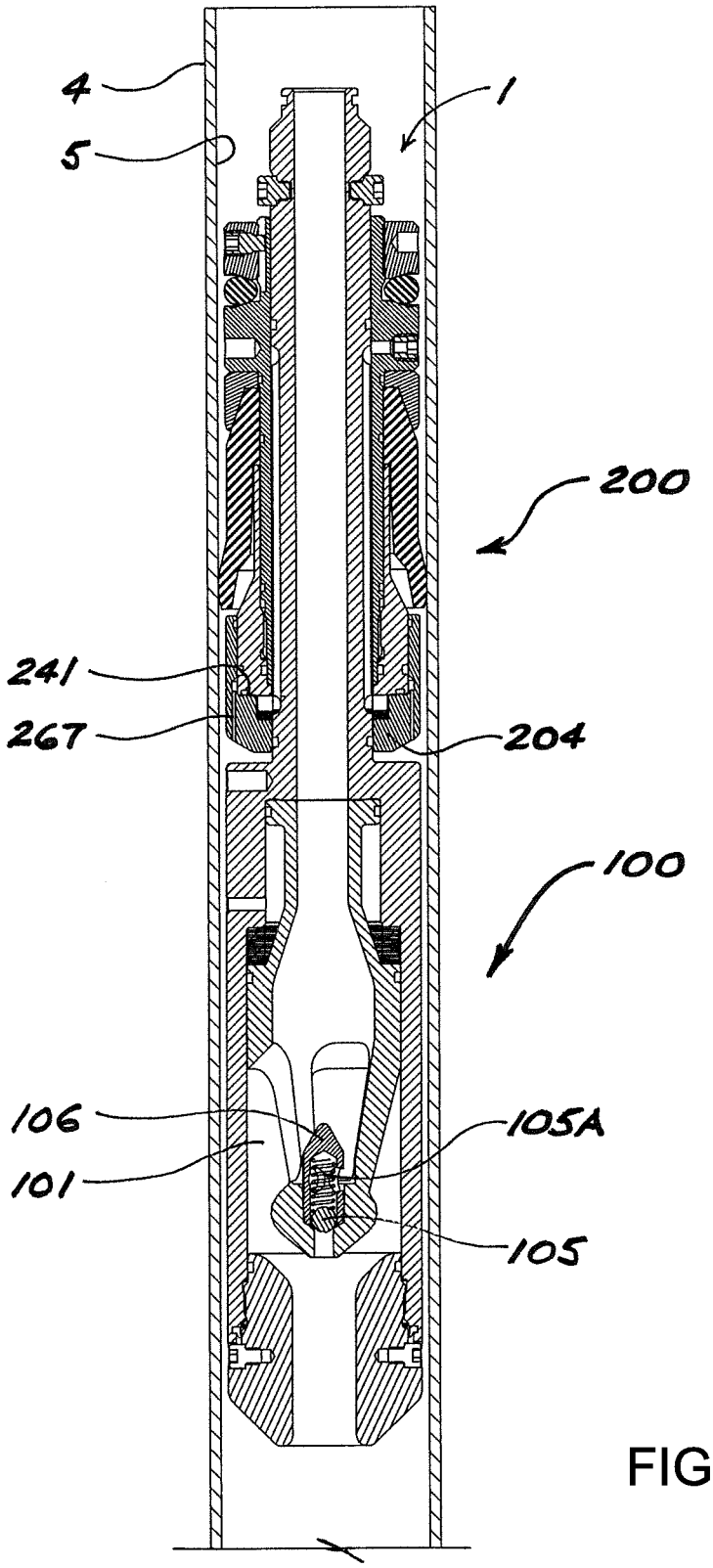
FIG. 6 is a section similar to FIG. 4 but showing the FMT as it would appear during inflow with sufficient casing pressure to close the air bleed valve; i.e., with mud saver valve open, suction seal disengaged from the casing, and air bleed valve closed.

FMT 1 is provided with mud saver biasing means operative to bias mud saver spool 101 toward a closed position with nose cone 104 seated against end cap 103. The mud saver biasing means is shown in the illustrated embodiment as (but not limited to) a mud saver bias spring 102 disposed around upper section 108 of mud saver spool 101 so as to bear at its upper end against upper spring shoulder 20 on main body 10, and at its lower end against lower spring shoulder 118 on mud saver spool 101, such that mud saver spool 101 is biased toward the lower or downstream end of main body 10. Upward travel of mud saver spool 101 within main body 10 will be restricted by upper mud saver shoulder 18, against which flange 107 may abut when mud saver spool 101 is at its uppermost position relative to main body 10 (e.g., as shown in FIGS. 4, 5, and 6).

Figure 7:
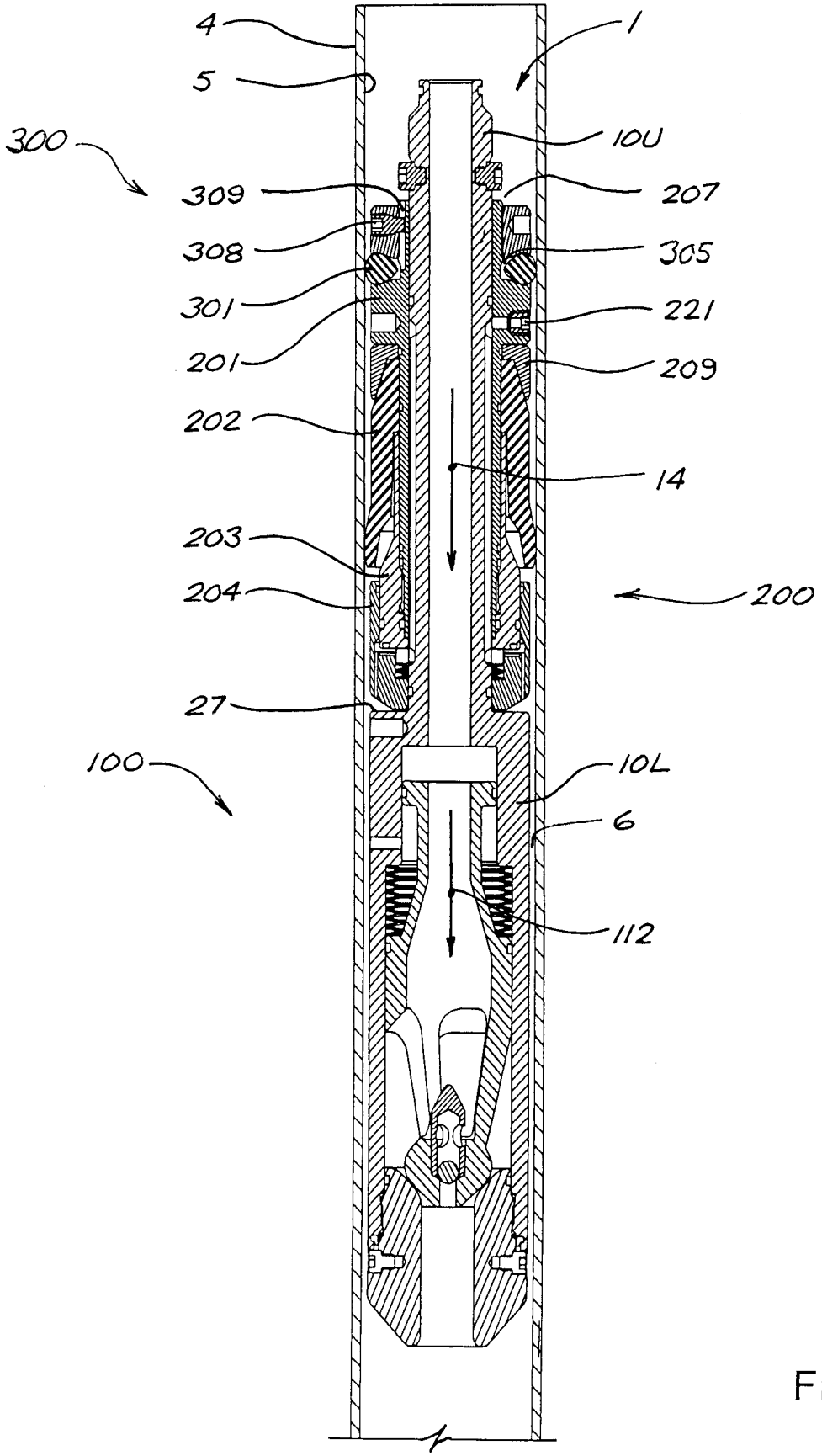
FIG. 7 is a section similar to FIG. 4 but showing the FMT as it would appear without inflow and with the casing under suction; i.e., with mud saver valve closed, check valve closed, air bleed valve open, and secondary suction seal engaging the casing.

Nose cone seal surface 114A and end cap seal surface 156 have complementary profiles (such as but not limited to frustoconical profiles) for sealing engagement in a contact seal region 153 when mud saver spool 101 is at its lowermost position relative to main body 10 (e.g., as shown in FIGS. 2 and 7). Preferably, the profiling of nose cone seal surface 114A and end cap seal surface 156 will also be such as to facilitate smooth fluid flow from mud saver cage bore 110B into end cap discharge bore 155 when nose cone seal surface 114A and end cap seal surface 156 are not in contact.

In preferred embodiments, contact seal region 153 will approximate a circular line of minimal width, and lying in a plane transverse to the longitudinal axis of FMT 1. This configuration of contact seal region 153 is desirable to facilitate precise determination of differential pressures (as described later herein) for purposes of designing FMT 1 for case-specific operational service conditions. It is also generally desirable for contact seal region 153 to be of minimal width to maximize local contact pressure between nose cone seal surface 114A and end cap seal surface 156 (given that the total force over contact seal region 153 will be the same irrespective of the width of contact seal region 153), and thereby to enhance sealing effectiveness over contact seal region 153. However, it may be desirable in some cases for contact seal region 153 to have a distinct and measurable radial width, and corresponding alternative embodiments are intended to be within the scope of the present disclosure. Irrespective of the geometry of contact seal region 153, seal effectiveness may be further enhanced by applying a seal-promoting coating to nose cone seal surface 114A and/or end cap seal surface 156 in areas corresponding to contact seal region 153.

The relative locations of upper and lower spring shoulders 20 and 118 will typically be coordinated with the length and stiffness of mud saver bias spring 102 to provide a selected initial prestress force (also referred to herein as biasing force $F_B$) to compress spring 102 between upper and lower spring shoulders 20 and 118, thus biasing mud saver spool 101 toward a closed position in which nose cone seal surface 114A and end cap seal surface 156 are in sealing contact.

Although the mud saver biasing means has been described and illustrated herein as taking the form of a spring, persons skilled in the art will appreciate that alternative embodiments may use a different type of biasing means with functionally equivalent effect. For example, the mud saver biasing means could be provided in the form of an air spring. For some operational applications, the force of gravity may effectively serve as a mud saver biasing means tending to keep mud saver spool 101 in a closed position.

The location of upper mud saver shoulder 18 relative to spool flange 107 is selected to allow mud saver spool 101 to slide in the upstream direction a selected amount sufficient to allow contact seal region 153 to open, and thus placing mud saver spool 101 in an open position allowing fluid flow from mud saver cage bore 110B around nose cone 104 and into end cap discharge bore 155 (or vice versa). In preferred embodiments, a vent 22 is provided through wall 16 of main body 10 at a point between the cylindrical areas swept by each of upper and lower spool seals 117 and 119, such that the pressure at end cap discharge bore 155 will be in pressure communication with annular chamber 157 between upper spool seal 117 and lower spool seal 119 irrespective of the position of mud saver spool 101. When provided, vent 22 preferably will incorporate a unidirectional seal acting as a check valve to allow fluids to vent from annular chamber 157 while preventing entry of fluids into annular chamber 157.

For explanatory purposes, the cross-sectional area of middle interval 15M of bore 15 (i.e., corresponding to upper mud saver seal surface 19) will be referred to as area $A_1$, and the cross-sectional area of lower interval 15L (corresponding to lower mud saver seal surface 21) will be referred to as area $A_2$. In addition, the circular cross-sectional area defined by contact seal region 153 will be referred to as area $A_3$ (which as previously discussed will be calculable with greatest precision when contact seal region 153 defines a circular line of minimal width). In accordance with the present disclosure, the relationship between these three areas may be expressed by the relationship $A_1<(A_2-A_3)$; i.e., $A_3$ is less than $A_2$, and $A_1$ is less than the difference between $A_2$ and $A_3$.

Having regard to the foregoing description, it will now be apparent to persons skilled in the art that the axial position of mud saver spool 101 within lower section 10L of main body 10 will depend on the balance of forces acting upon it. This in turn will depend on the pressure in main body flow path 14 (and mud saver flow path 112); the pressure within annular chamber 157; and the biasing force $F_B$ applied by the biasing means (e.g., mud saver bias spring 102) to bias mud saver spool 101 toward the closed position.

This may be perhaps best appreciated with reference to FIG. 7, in which mud saver spool 101 is shown in the closed position, with casing annulus 6 sealed off by primary seal 202 and secondary suction seal 301 (both of which are described later herein). In this situation, the casing pressure will typically approximate atmospheric pressure immediately after insertion of FMT 1 into a casing string 4, and the pressure in annular chamber 157 will correspond to the casing pressure by virtue of vent 22. When a fluid (such as drilling mud) is then pumped into FMT 1 along flow paths 14 and 112, a differential pressure $P_D$ will develop equal to the pressure in mud saver spool bore 110 minus the casing pressure. Mud saver spool 101 will tend to remain closed until the force acting upward on mud saver spool 101 due to differential pressure $P_D$ balances biasing force $F_B$; i.e., when $P_D(A_2-A_1-A_3)=F_B$. The value of $P_D$ necessary to meet this condition may be referred to as the mud saver opening pressure, and is selected to be sufficient to prevent drainage of fluid (e.g., drilling mud) from mud saver spool bore 110 under pressure developed by the gravity head in upstream flow line 3 (i.e., pressure not generated by pumping), but not higher than needed to prevent spillage.

Accordingly, it may be readily understood that when FMT 1 is withdrawn from casing 4 upon completion of a casing fill-up task, with no pumping pressure being introduced into mud saver spool bore 110, mud saver spool 101 will automatically close due to the biasing force $F_B$ being greater than the total of the weight of mud saver spool 101 and the volume of fluid (such as drilling mud) within FMT 1. The volume of fluid will thus be retained within FMT 1 as FMT 1 is withdrawn from casing 4, thus preventing fluid spillage.

FIG. 4 illustrates FMT 1 inserted into the upper end of a casing string 4 having an interior surface 5 forming casing annulus 6 with main body 10, with mud saver valve 100 shown in the open position, and with downstream fluid flow occurring along main body flow path 14 (i.e., bore 15 in main body 10) and mud saver flow path 112, (i.e., mud saver spool bore 110), and out through end cap discharge bore 155 into casing 4. Fluid flow through mud saver spool bore 110 causes the pressure at upper spool seal 117 to be less than the pressure at lower spool seal 119, as a function of increased flow velocity due to the venturi effect created by the expanding flow area from mud saver entry bore 110A to exit mud saver cage bore 110B and spool cage slots 113B. This pressure differential has the beneficial effect of tending to urge mud saver spool 101 further open, thereby reducing flow loss pressure and any tendency to erode nose cone seal surface 114A and end cap seal surface 156 in contact seal region 153 (due to the fact that the flow velocity across nose cone seal surface 114A and end cap seal surface 156 decreases as the gap between these surfaces widens, thus mitigating abrasive effects of the flowing fluid).

This desirable tendency for mud saver spool 101 to open more fully for a given flow rate can be further promoted by providing mud saver bias spring 102 with a lower stiffness in the range of deflection corresponding to the movement of mud saver spool 101 from the closed to open positions. By way of non-limiting example, this may be accomplished by providing mud saver bias spring 102 in the form of a spring having a linear load deflection response and low overall stiffness or, as illustrated in the Figures, in the form of a Belleville spring washer stack with a non-linear load deflection response (as is known in the art).

Referring now to FIG. 5, mud saver valve 100 is shown as it would appear with fluid backflow (conceptually indicated by arrow BF) tending to open backflow check valve 104, displacing check valve ball 105 upward and thereby allowing backflow through nose cone bore 115 and openings 106A in check valve cage 106. However, in cases where desired backflow rates are high, check valve 104 could present an undesirably high flow resistance or, even worse, check valve 104 could become plugged, in which case mud saver valve 100 would tend to trap pressure in the casing if it were to remain closed. Under such backflow pressure conditions, however, mud saver spool 101 will tend to move to the open position due to the force exerted by pressure over the area defined by contact seal region 153 overcoming biasing force $F_B$ in mud saver bias spring 102, thereby allowing relief of casing pressure via mud saver spool bore 110 and bore 15 in main body 10.

Figure 4A:
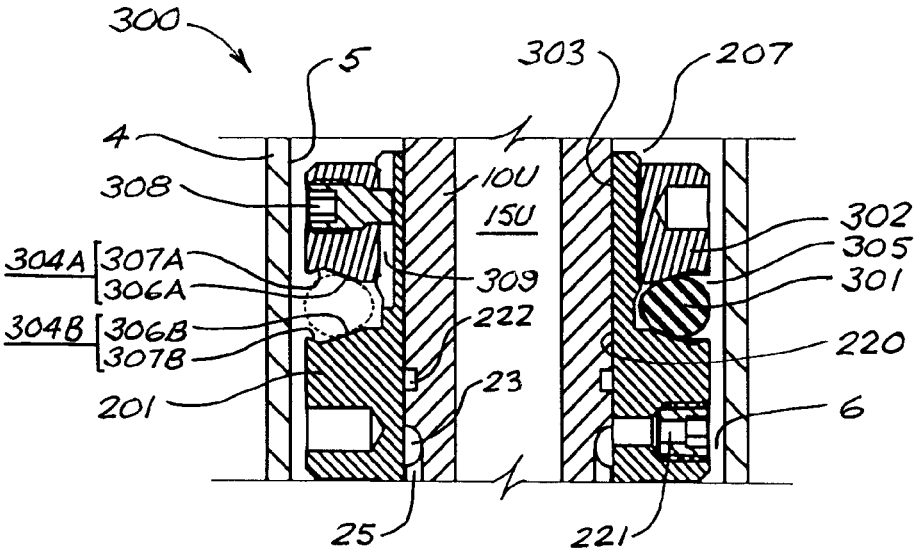
FIG. 4A is an enlarged detail of the suction seal assembly in FIG. 4.
Figure 4B:
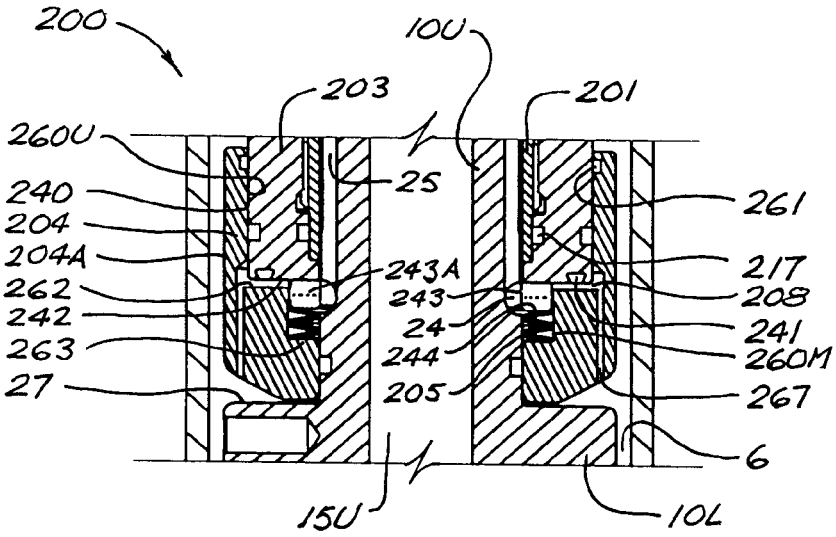
FIG. 4B is an enlarged detail of the main seal and air bleed valve subassembly in FIG. 4.

Referring again to FIG. 4 and also to FIGS. 4A and 4B, main seal and air bleed valve subassembly 200 comprises a seal carrier 201, a main seal 202, an air bleed valve body 203, and an air bleed spool 204 (all being of generally cylindrical and axi-symmetric configuration), plus air bleed biasing means provided in the illustrated embodiment in the form of (but not limited to) an air bleed bias spring 205. Seal carrier 201 is disposed coaxially around upper section 10U of main body 10, and has a seal carrier bore 220 which fits closely with upper section 10U. Main seal 202 (which by way of non-limiting example could be provided as a packer-cup-style seal as illustrated, or as a wedge seal) is sealingly mounted to seal carrier 201 by means of a seal retainer cup 209 and associated seals so as to be sealingly engageable with interior surface 5 of casing 4 and thereby to seal against annular flow between seal carrier 201 and casing 4 under the action of pressure developed at end cap discharge bore 155.

Upper section 10U of main body 10 is shown provided with a carrier body seal 222, for sealing engagement with seal carrier bore 220. Various other seals are shown but not labelled in the drawings, and it is to be understood all illustrated seal arrangements and locations are exemplary and non-limiting unless functional considerations clearly and unmistakably dictate otherwise. Additional and differently-configured seals may be incorporated into FMT 1 as desired or required to suit specific design requirements without departing from the present disclosure.

Upper section 10U of main body 10 is also shown having an upper annular groove 23 in upper section 10U below carrier body seal 222; a lower annular groove 24 located below seal carrier 201; and a plurality of spaced axial grooves 25 extending between connecting upper and lower annular grooves 23 and 24. Upper annular groove 23 is arranged to align with one or more air bleed vent ports 221 extending through the wall of seal carrier 201 at a selected location above main seal 202. Air bleed valve body 203 is sealingly attached to seal carrier 201 at a selected point below main seal 202. Air bleed valve body 203, which is generally axi-symmetric, has an exterior cylindrical outer seal surface 240 and an annular lower end face 242 which carries a face seal 241. As shown in FIG. 4B, one or more annular seals 217 may be carried by either seal carrier 201 or by air bleed valve body 203 for sealing therebetween.

Air bleed valve body 203 also includes a generally annular abutment 243 projecting downward from lower end face 242 radially inward from face seal 241, with the lower face of annular abutment 243 serving as an upper air bleed spring shoulder 244. Annular abutment 243 is formed with a plurality of radial channels or slots 243A, and in the assembled apparatus is aligned with lower annular groove 24 such that lower annular groove 24 will be in fluid communication with the air bleed entry ports 267 (described below) in air bleed spool 204 via slots 243A when air bleed spool 204 is in an open position (as will be described).

Air bleed spool 204, which also is generally axi-symmetric, has a lower end 266; a cylindrical outer surface 204A; and a stepped bore defining an upper cylindrical surface 260U, a middle cylindrical surface 260M having a smaller diameter than upper cylindrical surface 260U, and a lower cylindrical surface 260L having a smaller diameter than middle cylindrical surface 260M. An annular seal shoulder 262 is provided at the juncture of upper and middle cylindrical surfaces 260U and 260M, and an annular lower air bleed spring shoulder 263 is provided at the juncture of middle and lower cylindrical surfaces 260M and 260L. As best seen in FIG. 4B, upper cylindrical surface 260U is coaxially disposed around the lower end of air bleed valve body 203, and carries an outer sliding seal 261 which slidably and sealingly engages outer seal surface 240 of air bleed valve body 203. Lower cylindrical surface 260L (alternatively referred to as inner sliding seal bore 260L) is configured to be close fitting with an inner sliding seal 26 carried on upper section 10U of main body 10.

In the illustrated embodiment, main body 10 is configured to have an annular exterior shoulder 27 at the juncture of upper and lower sections 10U and 10L, and exterior shoulder 27 serves as an abutment for lower end 266 of air bleed spool 204. In the assembled apparatus, air bleed spool 204 is thus allowed to move between a closed position constrained by contact between face seal 241 on air bleed valve body 203 and seal shoulder 262 of air bleed spool 204, and an open position in which air bleed spool 204 is downwardly displaced from face seal 241 on air bleed valve body 203 toward exterior shoulder 27 on main body 10. Air bleed bias spring 205, shown in the illustrated embodiment as a Belleville spring stack, is disposed between upper air bleed spring shoulder 244 on annular abutment 243 on air bleed valve body 203 and lower air bleed spring shoulder 263 on air bleed spool 204. Air bleed bias spring 205 is designed and configured to apply a force biasing air bleed spool 204 toward the open position. At least one and preferably a plurality of air bleed entry ports 267 are provided in air bleed spool 204 whereby casing annulus 6 is in fluid communication with an annular space 208 that will open up between seal shoulder 262 on air bleed spool 204 and lower end face 242 of air bleed valve body 203 when air bleed spool 204 is in the open position (as in FIGS. 4 and 4B).

Although main body 10 in the illustrated embodiment has an annular exterior shoulder 27 serving to limit downward travel of air bleed spool 204 on air bleed valve body 203, it is not essential to provide such a shoulder for that purpose. Persons skilled in the art will readily appreciate that the downward travel of air bleed spool 204 could be limited by other means in accordance with known methods; such as, for example, by providing stop means in a suitable location between air bleed valve body 203 and air bleed spool 204.

For reference purposes, the pressure present at a given time within casing annulus 6 below main seal 202 will be referred to as the casing pressure. When air bleed spool 204 is in the open position, main seal and air bleed valve assembly 200 provides a flow path 206 as shown in FIG. 4 to relieve casing pressure by way of the flow of fluid: (1) from casing annulus 6 into air bleed entry ports 267; (2) radially inward through annular space 208 past open face seal 241; (3) radially inward through radial slots 243A in annular abutment 243 on air bleed valve body 203; (4) into lower annular groove 24; (5) upward along axial grooves 25; (6) into upper annular groove 23; and (7) exiting through air bleed vent ports 221 in seal carrier 201.

It will be apparent that flow path 206 will remain open and will continue to vent casing annulus 6 until the force arising from the pressure differential acting on the annular area defined by outer sliding seal surface 240 on air bleed valve body 203 and inner sliding seal bore 260L on air bleed valve spool 204 is sufficient to overcome the force of air bleed bias spring 205 (plus any other loads such as loads imposed by gravity and/or seal friction), thereby causing air bleed spool 204 to move into the closed position as shown in FIG. 6. The flow required to induce a pressure differential across air bleed entry ports 267 sufficient to cause this movement just prior to closure of air bleed valve spool 204 will result in some back pressure along axial grooves 25 downstream of face seal 241 (i.e., axial grooves 25 being downstream of face seal 241 in the context of the venting of casing annulus 6 via flow path 206). Accordingly, subsequent to closure of air bleed valve spool 204 this back pressure will decline, tending to increase the differential pressure force causing air bleed valve closure, and thus providing a feedback mechanism to ensure more positive closure and a lower re-opening pressure.

It should be noted that although air bleed bias spring 205 in the illustrated embodiments is situated below face seal 241 and the annular space 208 associated with seal shoulder 262 on air bleed spool 204 and lower end face 242 of air bleed valve body 203, this is not essential. Persons skilled in the art will readily appreciate that air bleed valve body 203 and air bleed spool 204 could be alternatively configured to house air bleed bias spring 205 in a location above face seal 241 and annular space 208, with satisfactory functional effectiveness. Such alternative location of air bleed bias spring 205 would have the beneficial effect of protecting air bleed bias spring 205 from exposure to drilling mud or other fluids (liquid or gaseous) flowing along flow path 206.

It will be apparent to persons skilled in the art that the flow channel characteristics governing this bi-stable behaviour (i.e., air bleed spool 204 tending to stay open when open, and tending to stay closed when closed) can be manipulated by adjusting the spring characteristics to provide a reopening pressure lower than the mud saver opening pressure. This characteristic is particularly desirable in applications where the air bleed valve is used to vent air during casing filling with liquids (such as drilling mud) and then to apply pressure (such as by pumping) to circulate the liquids, because a lower reopening pressure allows circulation at lower pressure without mud seepage through flow channel 206, and similarly tends to minimize liquid spillage when fluid flow pressure is reduced to allow removal of fluid management tool 1 from casing 4.

Referring now to FIGS. 4A and 7, suction seal subassembly 300 is mounted around an upper region of seal carrier 201, and in the illustrated embodiment is configured as a tapered-gland-supported annular seal of a type disclosed in U.S. patent application Ser. No. 12/484,984 (the entirety of which is incorporated herein by reference). Suction seal subassembly 300 includes a gland nut 302 mountable onto the upper end 207 of seal carrier 201 by means of a threaded connection 303, and a toroidal suction seal element 301 disposed within a gland groove 305 formed between (1) an upstream gland face 304A on gland nut 302 and (2) a complementary downstream gland face 304B formed on seal carrier 201. Suction seal element 301 is made from a suitably compliant material such as an elastomer. For clarity in identifying various features of suction seal subassembly 300, suction seal element 301 is shown partially in broken outline in FIG. 4A.

In accordance with the teachings of U.S. patent application Ser. No. 12/484,984, and as best seen in FIG. 4A, each of gland faces 304A and 304B preferably defines a frustoconical inner seal support surface 306A (or 306B) contiguous with a frustoconical outer seal retention surface 307A (or 307B). Gland groove 305 formed by opposing gland faces 304A and 304B thus comprises: (1) an inner groove interval formed by opposing inner support surfaces 306A and 306B, and having a radially-outwardly-increasing axial groove width, and (2) an outer groove interval formed by opposing frustoconical seal retention surfaces 307A and 307B, and having a radially-outwardly-decreasing groove width.

The axial position of gland nut 302 on seal carrier 201 can be adjusted by rotation in a first direction (typically clockwise) about threaded connection 303 to narrow the axial width of gland groove 305, thereby increasing the radially-outward deformation of suction seal element 301 as it is axially compressed between seal support surfaces 306. In FIG. 4, suction seal element 301 is shown disengaged from interior surface 5 of casing 4. In FIG. 7, gland nut 302 has been rotated to narrow the width of gland groove 305, thereby compressing suction seal element 301 such that it projects radially from gland groove 305 to sealingly engage interior surface 5 of casing 4 (in which condition gland nut 302 may be considered to be in a closed position). Accordingly, the contact pressure between suction seal element 301 and interior surface 5 of casing 4 can be increased by further rotation of gland nut 302 in the first direction, while rotation of gland nut 302 in the opposite direction will reduce the seal contact pressure or cause suction seal element 301 to be retracted completely away from interior surface 5 of casing 4 (in which condition gland nut 302 may be considered to be in an open position).

Retention of gland nut 302 in a selected open or closed position may be facilitated by providing gland nut locking means, for releasably restraining rotation of gland nut 302 about seal carrier 201. The embodiment shown in FIG. 4A incorporates gland nut locking means in the form of threaded lock pins 308 extending radially through gland nut 302 and rotatable to bear against an outer surface of seal carrier 201, thus releasably restraining rotation of gland nut 302 about seal carrier 201 and thereby maintaining gland nut 302 in a desired axial position. Alternative means for releasably restraining rotation of gland nut 302 will be well within the knowledge of persons skilled in the art, and all such alternative means are intended to come within the scope of the present disclosure.

One or more flow channels 309 may be provided in gland nut 302 to allow atmospheric pressure communication between the upper end of FMT 1 and a lower region of gland groove 305, such that under conditions where the casing pressure falls below atmospheric pressure (i.e., suction) and gland nut 302 is closed, suction seal element 301 will tend to prevent flow of air into casing 4, as will carrier body seal 222. Conversely, in the presence of positive casing pressure, suction seal element 301 will tend to allow casing pressure to vent through flow channel 309, which thus acts as a check valve allowing air to escape but not to enter the interior of casing 4. When it is not required to seal against suction, gland nut 302 may be selectively moved to an open position, to reduce wear on suction seal element 301 during typical operations where FMT 1 needs to traverse the connections between the individual joints of pipe making up casing string 4 as FMT 1 is inserted into and removed from casing 4.

In the embodiment shown in FIG. 4A (and other Figures), a lock pin 308 is shown coinciding with a flow channel 309. However, this is exemplary only, and any or all of lock pins 308 may be located between adjacent flow channels 309.

Figure 8:
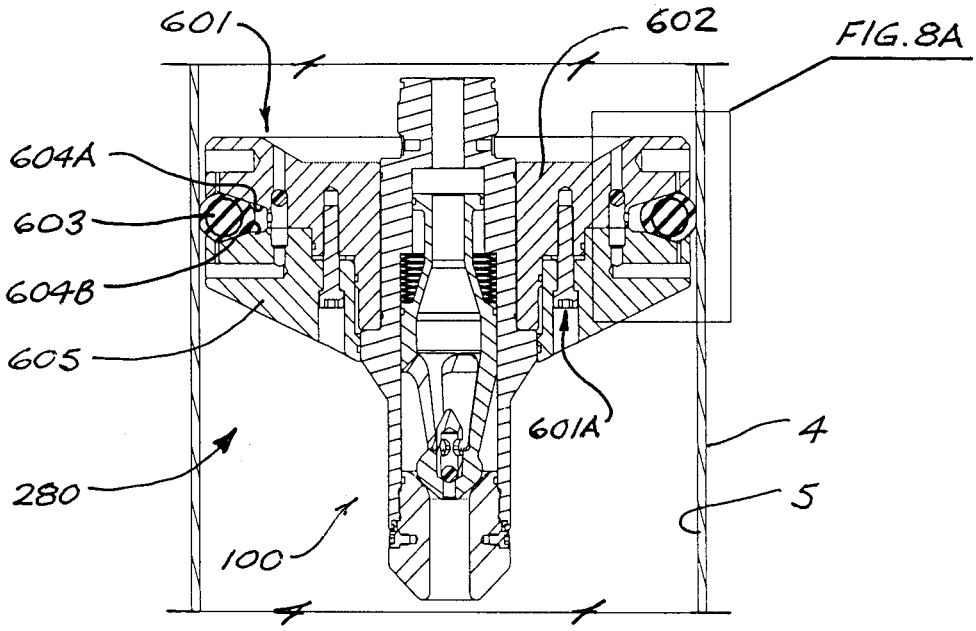
FIG. 8 is a cross-sectional view of a fluid management tool in accordance with an alternative embodiment, incorporating a bi-directional check valve to seal fluid pressure originating from the lower end of the tubing.
Figure 8A:
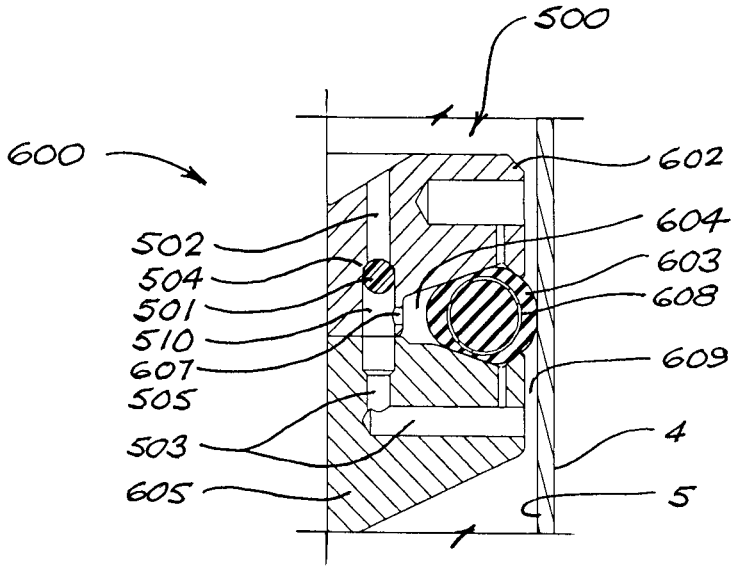
FIG. 8A is an enlarged detail of the bi-directional check valve shown in FIG. 8.

FIGS. 8 and 8A illustrate a fluid management tool (FMT) 280 in accordance with an alternative embodiment, incorporating a bi-directional seal assembly 600 in place of the primary seal 202 and secondary suction seal 301 of the embodiment shown in the other Figures. In the illustrated embodiment, FMT 280 comprises a modified main body 10' carrying a mud saver spool 101 which in combination constitute a mud saver valve 100 structurally and functionally similar to mud saver valve 100 of the embodiment illustrated in the other Figures. Bi-directional seal assembly 600 comprises a generally annular seal carrier 601 coaxially mounted around an upper region of main body 10', and which in the illustrated embodiment comprises an upper seal retainer 602 and a lower seal retainer 605 (assembled to form seal carrier 601 using suitable connectors or other connection means represented by reference number 601A). Upper and lower seal retainers 602 and 605 define opposing upper and lower seal faces 604A and 604B respectively, profiled similar to opposing faces 304A and 304B in suction seal subassembly 300 in the embodiment shown FIG. 4A, so as to form a seal groove 604 configured in largely the same fashion as gland groove 305 shown in FIG. 4A. A toroidal seal element 603 made from a suitably compliant material is disposed within seal groove 604 such that seal element 603 projects radially outward from seal groove 604 so as to be sealingly engageable with the inner surface 5 of a casing string 4.

Seal element 603 preferably incorporates reinforcing means, which is the illustrated embodiment is provided in the form of a wire backup element 608 integral with and internal to seal element 603 such that no part of wire backup 608 is exposed. In some situations, however, it may be desirable for a portion or surface of wire backup 608 to be exposed on non-sealing faces of seal element 603, to facilitate accurate positioning of wire backup 608 within seal element 603 during manufacture. In FIGS. 8 and 8A, wire backup 608 is shown by way of non-limiting example as a helical spring such as a garter spring.

The wire diameter and pitch of a helical spring used for wire backup 608 will preferably be selected to provide desired properties in terms of increased resistance to radial extrusion of seal element 603 with minimal increase in circumferential stiffness. Resistance to radial extrusion in this context is a measure of how readily seal element 603 will rebound from a deformed state when seal element 603 is disengaged from inner surface 5 of casing 4. For a seal element made from a given resilient material, the incorporation of wire backup 608 strengthens and stiffens seal element 603 such that its overall rebound characteristics effectively and desirably correspond to those of an unreinforced seal element made from a harder material, while at the same time tending to produce a more effective seal against inner surface 5 because it is more resilient than a harder material would be.

As used herein, the term circumferential stiffness denotes a measure of the amount of force necessary to resiliently alter the major diameter of seal element 603 or, stated differently, the circumferential stretchability of seal element 603. As a practical matter, it is desirable for seal element 603 to have a certain degree of circumferential stretchability so that a given seal element 603 can be used with casings having different inner diameters. For example, pipe of a given nominal size will have a specific outer diameter, but the inner diameter will vary according to the pipe wall thickness. If the major diameter of a seal element 603 can be resiliently adjusted within, for example, a 0.5-inch range, that particular seal element 603 can be used in perhaps two or three different casings having the same nominal size but different wall thicknesses, instead of needing to provide a different seal element 603 to suit each different inner casing diameter.

The additional stiffness and strength provided by wire backup 608 within seal element 603 increases the resistance of seal element 603 to extrusion into the annular space 609 between casing 4 and the outer surface of seal carrier 601. This arrangement is desirable in that it performs the functions of both a suction seal assembly and a main seal using only a single seal element, and the seal element has sufficient strength and stiffness to function at pressures typical of oilfield fluid fill-up, circulation, and cementing operations.

Although it will commonly be desirable for seal element 603 to incorporate wire backup 608, it may be noted that wire backup 608 (or alternative reinforcing means) will not be required or of significant practical benefit in all situations, particularly for larger-diameter casing sizes. Accordingly, wire backup 608 is not to be considered essential to the present disclosure.

In the illustrated embodiment, bi-directional seal assembly 600 comprises a bi-directional check valve 500, which is shown in the form of a ball check valve comprising: a check ball 501; an upper pressure port 502 extending into upper seal retainer 602 from an upper surface thereof; a lower pressure port 503 extending into lower seal retainer 605 from a lower surface thereof; a check ball chamber 510 located between upper and lower pressure ports 502 and 503 and in fluid communication therewith; a radial pressure port 607 extending in fluid communication between check ball chamber 510 and a radially inner region of seal groove 604; an upper seal seat 504 at the juncture of upper pressure port 502 and check ball chamber 510; and a lower seal seat 505 at the juncture of lower pressure port 503 and check ball chamber 510. The properties of ball 501 and seal seats 504 and 505 are selected in combination such that a seal will be readily effected when ball 501 is seated in either of seal seats 504 and 505. For enhanced sealing effectiveness, check ball 501 is may be made from a suitably compliant polymer material, while seats 504 and 505 are made from a rigid material such as steel. Alternatively, sealing effectiveness can be enhanced by making check ball 501 from a rigid material and seats 504 and 505 from a compliant material.

Under conditions where the differential pressure upstream from seal element 603 is positive, seal element 603 will tend to prevent flow of fluid into casing 4 by sealingly engaging both internal surface 5 of casing 4 and lower seal face 604B on lower seal retainer 605. The pressure differential across check ball 501 will urge ball 501 downward into sealing engagement with lower seal seat 505, thereby allowing fluid pressure through upper pressure port 502 and radial pressure port 607 into a region of seal groove 604 radially inboard of seal element 603, while preventing fluid flow into pressure port 503.

Under conditions where higher pressure is located in the lower end of casing 4, as in the case illustrated in FIG. 8A, the pressure differential across ball 501 will urge check ball 501 upward into sealing engagement with upper seal seat 504, thereby allowing fluid pressure through lower pressure port 503 and radial pressure port 607 into a region of seal groove 604 radially inboard of seal element 603, while preventing fluid flow into pressure port 502. Seal element 603 sealingly engages both inside surface 5 of casing 4 and upper seal face 604A of upper seal retainer 602 against downstream fluid movement.

It will be readily appreciated by those skilled in the art that various modifications may be devised without departing from the scope and teaching of the present disclosure, including modifications which may use equivalent structures or materials hereafter conceived or developed. It is to be especially understood that the scope of the disclosure is not intended to be limited to any described or illustrated embodiment, and that the substitution of a variant of a claimed element or feature, without any substantial resultant change in functionality, will not constitute a departure from the scope of the disclosure. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one such element is present, unless the context clearly requires that there be one and only one such element. Any form of the word "typical" is to be understood in the non-limiting sense of "common" or "usual", and not as suggesting essentiality.

Any use herein of any form of the terms "connect", "engage", "couple", "mount", "attach", or other terms describing an interaction between elements is not meant to limit the interaction to direct interaction between the subject elements, and may also include indirect interaction between the elements such as through secondary or intermediary structure. Relational terms such as "parallel", "perpendicular", "coincident", "intersecting", "circular", "symmetric", and "equidistant" are not intended to denote or require absolute mathematical or geometrical precision. Accordingly, such terms are to be understood as denoting or requiring substantial precision only (e.g., "substantially parallel") unless the context clearly requires otherwise.

What is claimed is:

1. A fluid management tool comprising:

(a) an elongate main body having an upper end, a lower end, and a main body bore extending between said upper and lower ends, said main body bore including: an upper interval; a middle interval defining a middle main bore surface having a cross-sectional area $A_1$; and a lower interval defining a lower main bore surface having a cross-sectional area $A_2$;

(b) an end cap mounted to the lower end of the main body, said end cap having an upper end defining an end cap seal surface, and an end cap discharge bore in fluid communication with the main body bore;

(c) a spool having an upper end, a lower end, and a spool bore extending between the spool's upper and lower ends, said spool comprising:

c.1 an upper spool section having a peripheral surface;

c.2 a middle spool section having a peripheral surface;

c.3 a spool cage having at least one slot; and c.4 a nose cone at the lower end of the spool, said nose cone defining a nose cone seal surface;

said spool being disposed and axially movable within the main body bore, with the upper spool section disposed within the middle interval of the main body bore, and with the middle spool section and the spool cage disposed within the lower interval of the main body bore;

(d) upper seal means, for sealing between the peripheral surface of the upper spool section and the middle main bore surface;

(e) lower seal means, for sealing between the peripheral surface of the middle spool section and the lower main bore surface; and (f) spool biasing means biasing the spool toward a closed position in which the nose cone seal surface is in sealing engagement with the end cap seal surface over a contact seal region enclosing an area $A_3$;

wherein area $A_3$ is less than area $A_2$, and $A_1$ is less than the difference between area $A_2$ and area $A_3$.

2. A fluid management tool as in claim 1 wherein the middle main bore surface, the lower main bore surface, the peripheral surface of the upper spool section, and the peripheral surface of the middle spool section are axi-symmetric.

3. A fluid management tool as in claim 1 wherein the upper seal means is carried by the peripheral surface of the upper spool section.

4. A fluid management tool as in claim 1 wherein the upper seal means is carried by the middle main bore surface.

5. A fluid management tool as in claim 1 wherein the lower seal means is carried by the peripheral surface of the middle upper spool section.

6. A fluid management tool as in claim 1 wherein the lower seal means is carried by the lower main bore surface.

7. A fluid management tool as in claim 1 wherein the upper spool section is configured such that an annular chamber is formed between the upper spool section and the middle main bore surface.

8. A fluid management tool as in claim 7 wherein a portion of the upper spool section defines a radially-extending flange comprising said peripheral surface of the upper spool section, thereby forming said annular chamber.

9. A fluid management tool as in claim 7, further comprising a vent extending from an outer surface of the main body into the annular chamber.

10. A fluid management tool as in claim 9 wherein the vent comprises a unidirectional seal.

11. A fluid management tool as in claim 1 wherein the spool biasing means comprises a spring disposed around a lower region of the upper spool section, said spring having an upper end bearing against an upper spring shoulder formed on the main body at the juncture of the middle and lower intervals of the main body bore, and a lower end bearing against a lower spring shoulder formed on the middle spool section.

12. A fluid management tool as in claim 1 wherein the spool biasing means comprises an air spring.

13. A fluid management tool as in claim 1 wherein the spool biasing means uses gravity to bias the spool toward a closed position.

14. A fluid management tool as in claim 1, further comprising a backflow valve associated with the nose cone, and wherein the nose cone has a nose cone bore.

15. A fluid management tool as in claim 14 wherein the backflow valve comprises a check valve cage having one or more fluid openings, a check element seat associated with the upper end of the nose cone bore, and a flow check element sealingly engageable with the check element seat to prevent fluid flow downward through the nose cone bore.

16. A fluid management tool as in claim 15, further comprising a check element biasing spring disposed within the check valve cage and biasing the flow check element toward a closed position seated in the check element seat.

17. A fluid management tool as in claim 15 wherein the flow check element comprises a check ball.

18. A fluid management tool as in claim 15 wherein the flow check element comprises a poppet.

19. A fluid management tool as in claim 1 wherein the contact seal region defines a circular line.

20. A fluid management tool as in claim 1 wherein the main body comprises an upper section and a lower section, with an upwardly-oriented exterior annular shoulder formed at the juncture of said upper and lower sections of the main body.

21. A fluid management tool as in claim 20, further comprising a main seal and air bleed valve disposed around the upper section of the main body.

22. A fluid management tool as in claim 21, further comprising a suction seal disposed around the upper section of the main body above the main seal and air bleed valve.

23. A fluid management tool as in claim 20, further comprising a suction seal disposed around the upper section of the main body.

24. A fluid management tool as in claim 22, further comprising a check valve associated with the suction seal.

25. A fluid management tool (FMT) comprising:

(a) an elongate main body having an upper end, a lower end, and a main body bore extending between said upper and lower ends; and (b) an annular main seal and an air bleed valve disposed around the main body, said air bleed valve comprising:

b.1 a generally cylindrical air bleed valve body having an upper end and a lower end, said air bleed valve body being axially fixed relative to the main body of the FMT; and b.2 a generally cylindrical air bleed spool having an upper end, a lower end, an upper spool bore, and a lower spool bore; wherein:

b.2A the lower spool bore has a smaller diameter than the upper spool bore, such that an upwardly-oriented seal shoulder is formed at the juncture of the upper and lower spool bores;

b.2B the air bleed spool has one or more air bleed entry ports, each extending through the air bleed spool between an inlet at an outer surface of the air bleed spool and an outlet associated with said seal shoulder; and b.2C the air bleed spool is disposed around a lower region of the air bleed valve body, with the upper bore of the air bleed spool being in sealing engagement with the outer surface of the air bleed valve body, and with the lower bore of the air bleed spool being in sealing engagement with the outer surface of the main body of the FMT, and wherein the air bleed spool is axially movable relative to the air bleed valve body between:

an open position in which the seal shoulder of the air bleed spool is separated from the lower end of the air bleed valve body, such that fluid can flow through the one or more air bleed entry ports and radially inward through the gap between the seal shoulder and the lower end of the air bleed valve body; and a closed position in which the lower end of the air bleed valve body is in sealing engagement with the seal shoulder of the air bleed spool;

wherein:

(c) the main seal is mounted to the main body, and configured for sealing engagement with an inside surface of a tubular element into which the FMT has been inserted;

(d) the air bleed valve is disposed below the main seal, and the FMT is configured to provide a flow path within an annular space between the main body and said tubular element, said flow path enabling upward fluid flow from the tubular element through the air bleed valve, bypassing the main seal and exiting the FMT at a point above the main seal, when the differential pressure across the main seal is below a selected closure pressure; and (e) the air bleed valve is adapted to close and to remain closed when the differential pressure across the main seal is at or above the selected closure pressure, and to reopen when the differential pressure across the main seal is at or below a selected reopening pressure less than the selected closure pressure.

26. A fluid management tool as in claim 25, further comprising biasing means for biasing the air bleed spool toward the open position.

27. A fluid management tool as in claim 25, further comprising stop means for limiting downward travel of the air bleed spool relative to the air bleed valve body.

28. A fluid management tool as in claim 27, wherein the stop means comprises an annular shoulder formed on the main body of the FMT.

29. A fluid management tool as in claim 25, wherein:

(a) the main seal is carried by a generally cylindrical seal carrier disposed around the main body of the FMT;

(b) an upper annular groove is formed in the outer surface of the main body of the FMT at a location above the main seal;

(c) a lower annular groove is formed in the outer surface of the main body of the FMT, with at least a portion of said lower annular groove being disposed below the lower end of the air bleed valve body;

(d) one or more axial grooves are formed in the outer surface of the main body of the FMT, extending between and in fluid communication with said upper and lower annular grooves; and (e) one or more air bleed vent ports extend radially through the seal carrier above the main seal, said one or more air bleed vent ports being in fluid communication with said upper annular groove;

such that the flow path comprises, in sequence: the one or more air bleed entry ports; an annular space formed between the lower end of the air bleed valve body and the seal shoulder of the air bleed spool when the air bleed spool is in the open position; the lower annular groove; the one or more axial grooves; the upper annular groove; and the one or more air bleed vent ports in the seal carrier.

30. A fluid management tool (FMT) comprising:

(a) an elongate main body having an upper end, a lower end, and a main body bore extending between said upper and lower ends; and (b) an annular main seal and an air bleed valve disposed around the main body;

wherein:

(c) the main seal is mounted to the main body, and configured for sealing engagement with an inside surface of a tubular element into which the FMT has been inserted;

(d) the air bleed valve is disposed below the main seal, and the FMT is configured to provide a flow path within an annular space between the main body and said tubular element, said flow path enabling upward fluid flow from the tubular element through the air bleed valve, bypassing the main seal and exiting the FMT at a point above the main seal, when the differential pressure across the main seal is below a selected closure pressure;

(e) the air bleed valve is adapted to close and to remain closed when the differential pressure across the main seal is at or above the selected closure pressure, and to reopen when the differential pressure across the main seal is at or below a selected reopening pressure less than the selected closure pressure; and (f) the main body bore includes: an upper interval; a middle interval defining a middle main bore surface having a cross-sectional area $A_1$; and a lower interval defining a lower main bore surface having a cross-sectional area $A_2$;

and wherein the fluid management tool further comprises:

(g) an end cap mounted to the lower end of the main body, said end cap having an upper end defining an end cap seal surface, and an end cap discharge bore in fluid communication with the main body bore;

(h) a spool having an upper end, a lower end, and a spool bore extending between the spool's upper and lower ends, said spool comprising:

h.1 an upper spool section having a peripheral surface;

h.2 a middle spool section having a peripheral surface;

h.3 a spool cage having at least one slot; and h.4 a nose cone at the lower end of the spool, said nose cone defining a nose cone seal surface;

said spool being disposed and axially movable within the main body bore, with the upper spool section disposed within the middle interval of the main body bore, and with the middle spool section and the spool cage disposed within the lower interval of the main body bore;

(i) upper seal means, for sealing between the peripheral surface of the upper spool section and the middle main bore surface;

(j) lower seal means, for sealing between the peripheral surface of the middle spool section and the lower main bore surface; and (k) spool biasing means biasing the spool toward a closed position in which the nose cone seal surface is in sealing engagement with the end cap seal surface over a contact seal region enclosing an area $A_3$;

wherein area $A_3$ is less than area $A_2$, and $A_1$ is less than the difference between area $A_2$ and area $A_3$.

31. A fluid management tool (FMT) comprising:

(a) an elongate main body having an upper end, a lower end, and a main body bore extending between said upper and lower ends;

(b) a generally cylindrical main seal carrier disposed around and mounted to the main body;

(c) an annular main seal carried by the seal carrier, said main seal being configured for sealing engagement with an inside surface of a tubular element into which the FMT has been inserted; and (d) a secondary seal assembly disposed around the main body of the FMT above the main seal, said secondary seal assembly comprising:

d.1 a generally cylindrical secondary seal carrier disposed around and mounted to the main body above the main seal, said secondary seal carrier defining an upwardly-oriented first gland face and a cylindrical section extending above said first gland face, said cylindrical section being externally threaded;

d.2 an internally-threaded gland nut threadingly mountable to said cylindrical section and defining a downwardly-oriented second gland face; and d.3 a toroidal seal element of compliant material;

wherein:

d.4 the first and second glands, in combination, form a gland groove for receiving the seal element; and d.5 the gland nut can be rotated to axially compress the seal element between the first and second gland faces such that the seal element projects radially outward from the gland groove and into sealing contact with the interior surface of the tubular element.

32. A fluid management tool as in claim 31 wherein the secondary seal carrier is integral with the main seal carrier.

33. A fluid management tool as in claim 31 wherein the cylindrical section of the secondary seal carrier has one or more flow channels in fluid communication with a radially-inward region of the gland groove, such that said radially-inward region of the gland groove will be exposed to atmospheric pressure.

34. A fluid management tool as in claim 31, further comprising an air bleed valve as in claim 25.

35. A fluid management tool as in claim 31 wherein:

(a) the main body bore includes: an upper interval; a middle interval defining a middle main bore surface having a cross-sectional area $A_1$; and a lower interval defining a lower main bore surface having a cross-sectional area $A_2$;

and wherein the fluid management tool further comprises:

(b) an end cap mounted to the lower end of the main body, said end cap having an upper end defining an end cap seal surface, and an end cap discharge bore in fluid communication with the main body bore;

(c) a spool having an upper end, a lower end, and a spool bore extending between the spool's upper and lower ends, said spool comprising:

c.1 an upper spool section having a peripheral surface;

c.2 a middle spool section having a peripheral surface;

c.3 a spool cage having at least one slot; and c.4 a nose cone at the lower end of the spool, said nose cone defining a nose cone seal surface;

said spool being disposed and axially movable within the main body bore, with the upper spool section disposed within the middle interval of the main body bore, and with the middle spool section and the spool cage disposed within the lower interval of the main body bore;

(d) upper seal means, for sealing between the peripheral surface of the upper spool section and the middle main bore surface;

(e) lower seal means, for sealing between the peripheral surface of the middle spool section and the lower main bore surface; and (f) spool biasing means biasing the spool toward a closed position in which the nose cone seal surface is in sealing engagement with the end cap seal surface over a contact seal region enclosing an area $A_3$;

wherein area $A_3$ is less than area $A_2$, and $A_1$ is less than the difference between area $A_2$ and area $A_3$.

36. A fluid management tool (FMT) comprising:

(a) an elongate main body having an upper end, a lower end, and a main body bore extending between said upper and lower ends;

(b) a generally annular seal carrier mounted around an upper region of the main body, said seal carrier comprising an upper seal retainer and a lower seal retainer, wherein said upper and lower seal retainers define opposing upper and lower seal faces forming a seal groove;

(c) a toroidal seal element made of compliant material disposable within the seal groove such that the seal element projects radially outward from the seal groove so as to sealingly engage an inner surface of a tubular element into which the FMT has been inserted; and (d) a bi-directional check valve comprising:

d.1 a check element;

d.2 an upper pressure port extending into the upper seal retainer from an upper surface thereof;

d.3 a lower pressure port extending into the lower seal retainer from a lower surface thereof;

d.4 a check element chamber located between the upper and lower pressure ports and in fluid communication therewith;

d.5 a radial pressure port extending in fluid communication between the check element chamber and a radially inner region of the seal groove;

d.6 an upper seal seat at the juncture of the upper pressure port and the check element chamber; and d.7 a lower seal seat at the juncture of the lower pressure port and the check element chamber;

such that:

(e) when the pressure above the seal element is higher than the pressure below the seal element, the check element will be urged downward into sealing engagement with the lower seal seat, such that the radially inner region of the seal groove is in fluid communication with the region of higher pressure above the seal element; and (f) when the pressure above the seal element is lower than the pressure below the seal element, the check element will be urged upward into sealing engagement with the upper seal seat, such that the radially inner region of the seal groove is in fluid communication with the region of higher pressure below the seal element.

37. A fluid management tool as in claim 36 wherein the seal element incorporates reinforcing means.

38. A fluid management tool as in claim 37 wherein the reinforcing means comprises a wire element.

39. A fluid management tool as in claim 38 wherein the wire element comprises a helical spring.

40. A fluid management tool as in claim 36 wherein:

(a) the main body bore includes: an upper interval; a middle interval defining a middle main bore surface having a cross-sectional area $A_1$; and a lower interval defining a lower main bore surface having a cross-sectional area $A_2$;

and wherein the fluid management tool further comprises:

(b) an end cap mounted to the lower end of the main body, said end cap having an upper end defining an end cap seal surface, and an end cap discharge bore in fluid communication with the main body bore;

(c) a spool having an upper end, a lower end, and a spool bore extending between the spool's upper and lower ends, said spool comprising:

c.1 an upper spool section having a peripheral surface;

c.2 a middle spool section having a peripheral surface;

c.3 a spool cage having at least one slot; and c.4 a nose cone at the lower end of the spool, said nose cone defining a nose cone seal surface;

said spool being disposed and axially movable within the main body bore, with the upper spool section disposed within the middle interval of the main body bore, and with the middle spool section and the spool cage disposed within the lower interval of the main body bore;

(d) upper seal means, for sealing between the peripheral surface of the upper spool section and the middle main bore surface;

(e) lower seal means, for sealing between the peripheral surface of the middle spool section and the lower main bore surface; and (f) spool biasing means biasing the spool toward a closed position in which the nose cone seal surface is in sealing engagement with the end cap seal surface over a contact seal region enclosing an area $A_3$;

wherein area $A_3$ is less than area $A_2$, and $A_1$ is less than the difference between area $A_2$ and area $A_3$.

* * * * *